United States Patent [19]

Beling et al.

[11] 3,978,690

[45] Sept. 7, 1976

[54] SELECTIVE POSITIONING SYSTEM PARTICULARLY FOR CONTROLLING GUIDE BARS OF KNITTING MACHINES

[75] Inventors: Thomas E. Beling, Saxonville; John O. Morin, Bedford; Florian F. Yanikoski, Braintree, all of Mass.

[73] Assignee: SIGMA Instruments, Inc., Braintree, Mass.

[22] Filed: Jan. 15, 1975

[21] Appl. No.: 541,091

Related U.S. Application Data

[63] Continuation of Ser. No. 335,811, Feb. 26, 1973.

[52] U.S. Cl. ..... 66/205

[51] Int. Cl.[2] ..... D04B 23/00; D04B 27/00

[58] Field of Search ..... 66/154, 154 A, 86; 192/2, 142; 318/690

[56] References Cited

UNITED STATES PATENTS

| | | | |
|---|---|---|---|
| 1,543,402 | 6/1925 | Stevens | 192/2 |
| 2,681,717 | 6/1954 | Spurgeon | 192/2 |
| 2,746,583 | 5/1956 | Blevins | 192/2 |
| 2,892,520 | 6/1959 | Sinclair | 192/2 |
| 3,028,083 | 4/1962 | Beer | 192/2 |
| 3,762,184 | 10/1973 | Schur et al. | 66/154 A |

*Primary Examiner*—Ronald Feldbaum
*Attorney, Agent, or Firm*—Toren, McGeady and Stanger

[57] ABSTRACT

Knitting-machine guide bars, which carry columns of guides through and then along a row of knitting needles and are moved longitudinally along the row on the basis of the content of a programmable read-only memory. Stepping motors which respond to the memory rotate pinions in directions and numbers of steps determined by the memory. Racks engaging the pinions articulate respective adjustable-leverage levers which reciprocate the separate guide bars longitudinally along the row. Respective springs press each rack against each pinion transverse to the rack length so as to eliminate slack. Longitudinal movement of the bars is synchronized with their transverse movements through the needle row by sensing when the guides clear the front of the needles and producing a synchronizing pulse that gates appropriate signals from memory buffers to the motors; and producing a synchronizing pulse on a separate channel when the guides are clear of the rear of the needles. Braking means brake the motors with torques of about 50% of the maximum motor torques.

49 Claims, 4 Drawing Figures

SELECTIVE POSITIONING SYSTEM PARTICULARLY FOR CONTROLLING GUIDE BARS OF KNITTING MACHINES

This is a continuation of application Ser. No. 335,811 filed Feb. 26, 1973.

BACKGROUND OF THE INVENTION

This invention relates to positioning systems and particularly to means for positioning knitting machine guide bars.

Knitting machines usually have at least two guide bars. Each bar supports guides in the form of blades with eyelets through which warps are threaded. Each guide controls movement of the warps relative to the needles of the machine. It is the function of the guide bars to move the warps quickly to predetermined locations corresponding to the spaces between needles.

In many warp knitting machines the guide bars are moved by cams. Common cylindrical cams are used for short programs where the pattern repeats after 16 or 24 machine cycles. Longer programs are contained in chains. The height or thickness of each link determines the position of cam followers and consequently the guide bars. A chain is required for each guide bar. Although these chains are made up to 60 feet long, they are unable to contain some desirable programs.

Changing the machine from one knitting pattern to another usually involves changing cylindrical cams or chains. This is comparatively difficult. Also the chains are costly and if the required links are not available from stock at the knitting mill, there may be a delay while missing links are obtained.

Most tricot warp knit machines have needle spacings of 20, 24, 28, or 32 needles per inch. When changing from one spacing to another, the increments and positions of the guide bars must change accordingly. The changing of cams or chains is comparatively difficult and time consuming.

Also, cams only provide short programs. With chains it is difficult to move the pattern bars smoothly because of abrupt changes which occur between links. Thus, chain machines have limited speed capabilities.

Guide bars commonly require one or more sets of heavy springs which oppose the action of the cams, followers, and connecting rods used for positioning the guide bars. The spring forces must always exceed the forces of friction and inertia, both of which can reach high peaks at times. These springs function as a means of taking slack out of the entire train of elements in the positioning system. However, the spring forces which are always higher than the highest momentary opposing force cause wear in the several parts that are stressed by the springs. Furthermore, the springs are often decentered with respect to the main body of the guide bar. Thus they exert bending forces which tend to throw the bars and individual guides out of line.

The needles in such machines are spaced as close as 0.030 inch on centers. These must pass between guide blades which have warps threaded through their eyelets. Thus high accuracy is required for positioning the guide bars. Such high accuracy is needed to operate with the very slight clearances between the needles and guide bars.

An object of the present invention is to improve positioning systems, particularly for knitting machines.

Another object of this invention is to overcome the before-mentioned problems.

SUMMARY OF THE INVENTION

According to a feature of the invention these and other objects of the invention are attained, by moving the guide bars through a linking arrangement that transmits precise stepping movements from a stepping motor whose number of steps and direction of rotation is determined by an electrical control system operated from a pre-programmed programmable read-only memory. The term stepping motor is used herein interchangeably with the term stopper motor. According to another feature of the invention the read-only memory includes the information for stepping several stepping motors each one of which operates a guide bar through a linking arrangement, with each guide bar cooperating with the needles.

According to another feature of the invention the read-only memory is in the form of a plug-in device that can be easily removed and replaced by another memory when the program is to be changed.

According to another feature of the invention, synchonizing means synchronize the addressing of the memory and the stepping of the motors to the main shaft of the machine so as to cause lateral movement of the guides only when they are clear of the needles.

According to yet another feature of the invention the motors are stepped on the basis of two separate sychronizing signals. The first synchronizing signal limits movement of the bars by the motors to not more than one step, i.e. one needle spacing, when the guides are behind the needles. The second synchronizing signal regulates operation of the stepping motors when the guides are in front of the needles and may move as many as six steps in either direction.

According to another feature of the invention rotating means connecting to rotate in unison with the main shaft cooperate with sensors adjacent thereto for producing the two synchronizing signals.

According to still another feature of the invention electronic circuit means responsive to the synchronizing signals interrogate the memories to drive the motors. The circuit means is divided into two channels. One channel actuates the motor so it is incapable of causing more than one step and this channel is active when the guides are behind the needles whereas the other channel is capable of causing up to six and perhaps seven steps.

According to another feature of the invention jogging means in the second channel are manually operable to align the guides to any desired initial position or for testing the mechanism.

According to another feature of the invention the linking arrangements or devices between the bars and motors each includes pinion means coupled to a motor and engaging rack means. Resilient means bias the pinion means and the rack means transversely against each other to prevent slack.

According to yet another feature of the invention the rack means drive levers articulated about fixed axes, and rod means couple the motion of the levers to the bars.

According to yet another feature of the invention the points on the lever which the rods engage is variable to change the degree of movement experienced by the bars for each step of the stepping motor.

According to still another feature of the invention, the linking arrangement is related to the steps of each stepping motor and the movement of the guide bars so that each step of a stepping motor moves a guide bar from one safe longitudinal position in which the guides on the guide bar will not interfere with the needles, directly to another safe longitudinal position in which the guides cannot interfere with the needles, without making an intermediate stop. Stable position of a stepping motor holds a guide in a safe position in which the guide will not interfere with the needles.

According to still another feature of the invention, brake means brake the stepping motor to an extent 80% or greater than the maximum torque of the motor. According to another feature of the invention, the brake means brake the motor to an extent 20% to 80% of the maximum torque of the motor.

According to still another feature of the invention, the fulcrum of the lever is shifted to offset the locus of the positions of the guide bar. The machine need not be stopped to effect this change.

These and other features of the invention are pointed out in the claims. Other objects and advantages of the invention will become evident from the following detailed description when read in light of the accompanying drawings.

DESCRIPTION OF PREFERRED EMBODIMENTS

Figure 1:
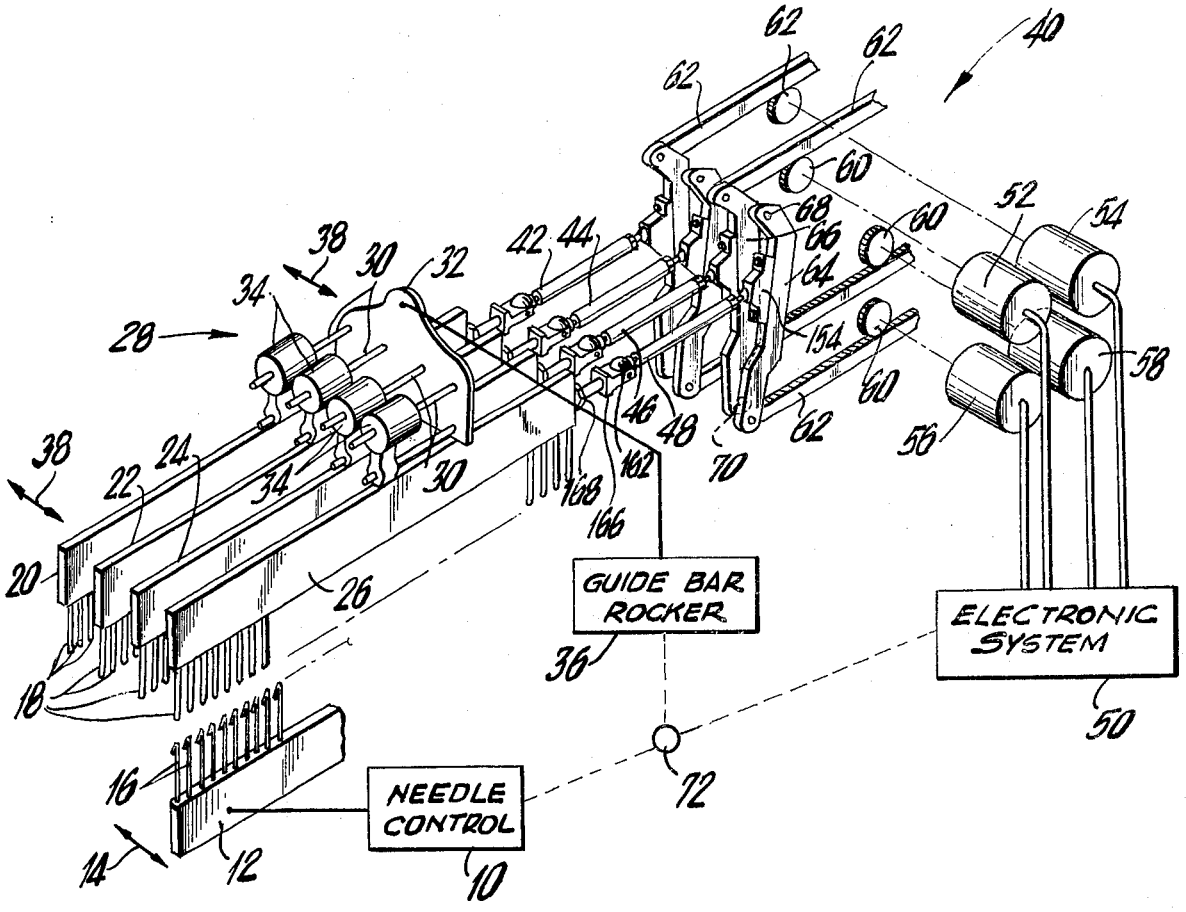
FIG. 1 is a partly perspective, partly schematic diagram of a knitting system embodying features of the invention.

In FIG. 1 a needle control 10 supports a needle bar 12 and moves it back and forth transverse to the bar's longitudinal direction as shown by the arrows 14. The movement causes a row of knitting needles 16 mounted on the bar 12 repeatedly to enter and leave the spaces between guides 18 mounted in 4 rows on 4 guide bars or pattern bars 20, 22, 24, and 26. A support arrangement 28 is composed in part of sliding shafts 30 mounted on a rocker panel 32, and sleeves 34 fixedly surrounding the shafts 30 and fixed to the individual guide bars 20, 22, 24, and 26. The support arrangement 28 maintains the pattern bars or guide bars 20 to 26 in parallel alignment while allowing the individual pattern bars to move longitudinally on the shaft 30. A guide bar rocker or pattern bar rocker 36 coupled to the rocker panel 32 rocks the guide bars 20 to 26 in unison transverse to their longitudinal directions as shown by the arrows 38. At the same time a guide or pattern bar control 40 utilizing guide or pattern rods 42, 44, 46, and 48 reciprocates the pattern bars longitudinally on the basis of predetermined programs.

Thus, as the needles 16 enter the spaces between the guides 18, the rocker 36 causes the guides 18 to execute a movement through the interdigital spaces between the needles 16 while the bar control 40 causes the guides to move parallel to the row of needles 16 both ahead of and behind the needles depending upon the stage of the cyclical movement by the rocker 36. The extent of the movement of the guide bars 20 to 26 along their longitudinal direction and the resulting movement of the guides relative to the needles establishes an essential part of the pattern being knitted. To vary the pattern, the bars 20 to 26 are reciprocated over varying length in synchronism with the control 10 and the rocker 36.

To operate the bars an electronic system 50 pulses four stepping motors 52, 54, 56, and 58 which form part of the pattern bar control 40. The pattern bar control 40 is shown in somewhat exploded form to keep the stepping motors from obliterating a view of the driving links. Each stepping motor 52 to 58 is connected to one of four pinions 60 that reciprocate respective racks 62 on the basis of digital signals applied by the electronic system to the motors 52 to 56. The stepping motors, on the basis of the signals applied thereto, turn the pinions in one direction or the other, step-wise, between specific stepped angular positions. The racks thus move one or more steps in either direction, or remain motionless depending upon the pulse signal applied by the system 50. Link levers 64 and 66 coupled to the ends of the racks 62 articulate about fulcrums 68 and 70. The levers 64 have their fulcrums 68 located at their tops while the levers 66 have their fulcrums located at their lower ends. The centers of the levers are linked with the rods 42 and 48. Thus as the racks are driven by the pinions 60 and the motors 52 to 58 on the basis of pulses from the electronic system 50, the levers 64 and 66 reciprocate the guide bars 20 to 26 by means of the rods 42 to 48. It should be noted here that the levers 64 and 66 are identical except for the locations of their fulcrums.

The needle control 10, the guide bar rocker 36, and the electronic system 50 are each coupled to the main operating shaft 72 of the system and are thereby synchronized with each other. In this way, the rocking movement of the guide bars 20 to 26, the rocking movement of the needle bars 12, and the reciprocating movement of the guide bars 20 to 26 are synchronized with each other.

Figure 2:
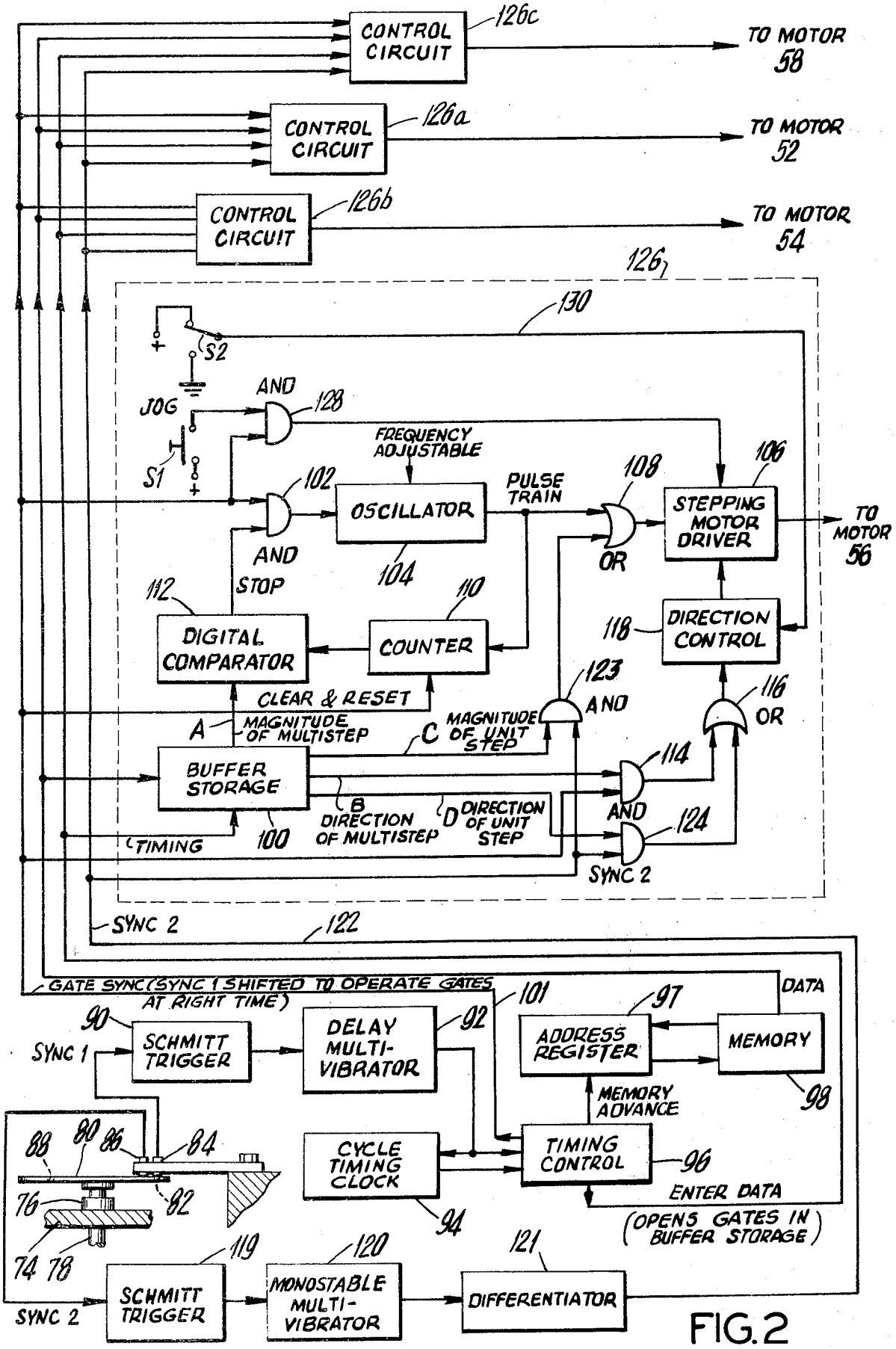
FIG. 2 is a partly pictorial, largely schematic diagram of the electronic system in FIG. 1.

FIG. 2 illustrates details of the electronic system 50. In the system 50 the knitting machine frame 74 supports a bearing 76 and a shaft 78 which rotates in unison with the main shaft 72. A synchronizing disc 80 secured to the shaft 78 rotates therewith and thus rotates in unison with the main shaft. A hole 82 in the disc 80 passes under a sensor 84 which produces a synchronizing signal SYNC 1. The sensor 84 may be of any convenient type, such as an optical device which senses the difference in reflected or incident radiation. According to an embodiment of the invention, the radiation used lies partly in the visible light range and partly in the infrared range. According to another embodiment of the invention the sensor 86 is magnetic and detects the presence or absence of a magnetic material which replaces the hole 82. According to another embodiment of the invention, the sensor 84 is a capacitance detector which senses the presence or absence of electrical conductors located in place of the hole 82. A sensor 86, such as a light sensor, magnetic sensor, or capacitive sensor, detects the presence or absence of an indication 88 such as a hole, magnetic material, or conductive material. The indication 88 is located at the other side of the disc 80 and passes the sensor 86 approximately one half revolution after the hole 82 passes the sensor 84. The actual locations of the indicators 82 and 88 which serve as timing or synchronizing elements, are determined by the type of knitting machine and the number of guide bars used. The sensor 86 produces a synchronizing signal SYNC 2.

According to a preferred embodiment of the invention the synchronizing signals SYNC 1 and SYNC 2 are set to occur just after the last of the guide bars causes its guides 18 to clear the needles 16 when moving toward the rear and again when the last guide bar causes its guides to clear the needles when moving toward the front.

When the guide bars are moved toward the front and just clear the needles the SYNC 1 signal is received as a rapid change in the output voltage of the sensor 84. The position of the indication 82 is accomplished experimentally. For example the knitting machine is operated slowly. When the guides in the guide bars have moved toward the front and just cleared the needles, a suitable indication can be placed on or cut into the disc 80 at a position beneath the sensor 84. The indication may be comparatively wide as long as the leading edge thereof is located at the sensor. A Schmitt trigger 90 senses the leading edge of the signal and toggles in one direction. At the trailing edge it returns to its quiescent state. A monostable multivibrator 92 responds to the leading edge of the output of the Schmitt trigger and shifts to a state which for convenience is here called the high state. It remains in this high state for a preselected period such as 30° (about 8 miliseconds) of the total cycle of the disc 80 and returns to its low state.

The leading edge of the high state of the delay multivibrator 92 starts a cycle timing clock 94 and at the same time turns on a gate in a timing control 96 so that pulses from the timing clock can enter the timing control. The timing control addresses an address register 97 which in turn interrogates a programmable read-only memory 98.

The register 97 interrogates the memory for six words, four words for the guides when they travel in front of needles and four half-words for the bars when they travel behind the needles. The timing control also opens gates in a buffer storage 100 by applying a signal on a line identified ENTER DATA to allow the buffer storage to receive the data output from the memory 98. The timing control 96 is essentially composed of gates and counters that direct the output from the memory and command execution by the buffer.

The timing control 96 delays the leading edge of the high state of the multivibrator 92 sufficiently to allow storage of the information in buffer storage 100. It then produces a gate synchronizing signal at a line 101. It then turns on an AND gate 102 which starts a frequency adjustable oscillator 104. The latter operates a stepping motor driver 106 through OR gate 108. A counter 110 counts the number of pulses emitted by the oscillator 104 and hence the number of steps the driver 106 is driving the stepping motor 56 to which it is connected. The buffer 100 stores a number of steps (a multistep) for guide travel in front of the needles, and a unit step for guide travel behind the needles, as well as directional data for both. A digital comparator 112 compares the number of pulses counted by the counter 110 with the magnitude of the multistep transmitted from the buffer storage 100 at the line A. When the number of pulses counted equals the number of the magnitude of the multistep from the buffer storage 100, the digital comparator turns off the gate 102 and stops the oscillator 104.

At the same time the direction in which the stepping motor 56 turns in response to the stepping motor driver 106 is determined by an output B from the buffer storage 100. The gate SYNC line 101 turns on and AND gate 114 which passes the direction information for the multistep on the output B through an OR gate 116 to a direction control 118 for the stepping motor driver 106. In this way the motor 56 is driven a number of steps and in a direction determined in the memory 98.

When the indication 88 reaches the sensor 86 it produces SYNC 2 signal. This occurs later than the indication 82 by about ½ revolution of the disc 80. The SYNC 2 signal operates a Schmitt trigger 119. A monostable multivibrator 120 responds to the leading edge of the output of the Schmitt trigger 119 and shifts to a state which is for convenience called its high state for 30° or so of the cycle of the disc 80. A differentiator 121 differentiates the signal and produces a SNYC 2 gating signal along a line 122 from the signal's leading edge.

The SYNC 2 gating signal on the line 122 turns on an AND gate 123 which transmits the magnitude of the unit step of the guide bar at the output C in the buffer storage 100 through an OR gate 108 to the motor driver 106. These signals, of course, occur long after the end of the pulse train from the oscillator 104 has been stopped by the gate 102. Moreover, no counter or comparator is necessary here because the unit step performed by the bars behind the needles is either one step or none.

The SYNC 2 gating signal also turns on an AND gate 124 so that the latter passes a signal from the buffer storage 100 along an output D through an OR gate 116 to the direction control 118. The direction control then determines the direction of the motor driver 106. This drives the motor 56 backwards or forwards one step as determined in the memory 98.

Each motor may be operated by a JOG signal at an AND gate 128. This is generated by operating a push-button switch S1, see FIG. 2. Each time the switch is operated, the stepping motor driver 106 is pulsed. This causes one motor step in the direction in which a switch S2 sets on a line 130. The jogging direction is set by the switch S2 applying a 0 to 1 to the control 118. Jogging is accomplished when initially positioning each guide bar to its appropriate position when starting a new program or when the guide bars are out of position for any reason.

Figure 3:
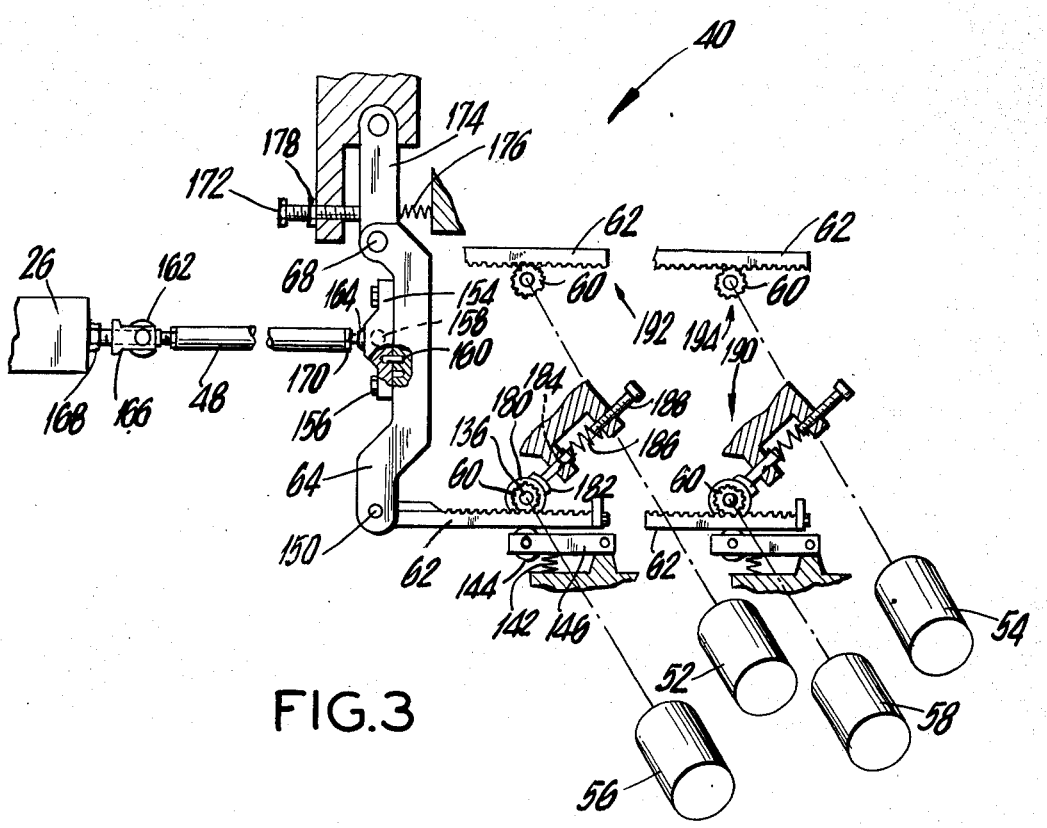
FIG. 3 is a detailed showing of the pattern bar control of FIG. 1 embodying features of the invention.

Details of at least a portion of the pattern bar control 40 appear in FIG. 3. Here the output shaft of the motors 56, 52, 54, and 58 operate on the basis of the signals from the control circuits 126, 126a, 126b and 126c. The mechanical linkages driven by the motors are substantially identical and the details of only one are shown. However, it will be understood that there are four mechanical linkages and each operates substantially the same way. A shaft 136 of the motor 56 is stepped on the basis of the control circuit 126 and causes one pinion 60 to rotate, thereby moving a rack 62. A spring 142 urges a roller 144 at the end of a lever 146 to push the rack 62 into firm engagement with the pinion 60. A pin 150 at the end of the rack 62 swings the lever 64 of FIG. 1 through an arc as the motor 56 is stepped the prescribed number of steps in the backward and forward direction. A block 154 fixed to the lever 64 by means of bolts 156 may be moved to one or more alternate locations on the lever so as to change the distance between the fulcrum 68 and a connecting pin 158. Precise locations are assured by means of a locating pin 160 and a plurality of mating holes in the lever 64. Locations are chosen as necessary to produce the desired motions at pin 158, such as 1/20 inch, 1/24 inch, 1/28 inch, and 1/32 inch for each step of motor 56.

The guide bar 26 of the knitting machine is connected to the pin 158 on the lever 64 by means of the guide rod 48 fitted at either end with ball swivel rod ends 162 and 164 and a yoke adapter 166 threaded with the guide bar. Coarse adjustments in rod lengths are made by varying the depth of engagement of the yoke into the guide bar. Lock units 168 and 170 secure the coarse adjustment. Fine adjustments are made by turning a screw 172 moving an adjusting lever 174 and the upper end of the lever 64. A strong spring 176 urges the lever 174 into constant engagement against the screw so as to prevent any slack. A lock nut 178 secures the adjusting screw. Any convenient thread-locking means may be used. A brake drum 180 is fixed to the shaft 136 of the motor 56 and engaged frictionally by a brake shoe 182. The shoe is guided by a key 184 which mates with the frame of the knitting machine so as to restrict movement of the shoe to essentially a radial direction. A spring 186 and adjusting screw 188 vary the force of the brake shoe as necessary to produce optimum stepping motor performance. Stronger brake forces are required for heavier guide bars which vary with the knitting machine. The above described mechanism is repeated for each step of each stepping motor and operates each guide bar of the knitting machine. The rack and pinion arrangement 190 operates with respect to the motor 58. Similarly rack and pinion arrangements 192 and 194 respond to the motors 52 and 54. These rack and pinion arrangements operate the remaining levers 64 and 66 as well as the guide bars 42 to 48. For convenience the levers 64 are articulated about upper fulcrums while the levers 66 are articulated about lower fulcrums. The motors 52 to 58 are mounted on a frame which supports bearings for the shafts rotating the pinions and the fulcrums 68. The racks are of different lengths as necessary to space the motors.

Pointers not shown are affixed to each motor shaft to show their positions at all times.

Figure 4:
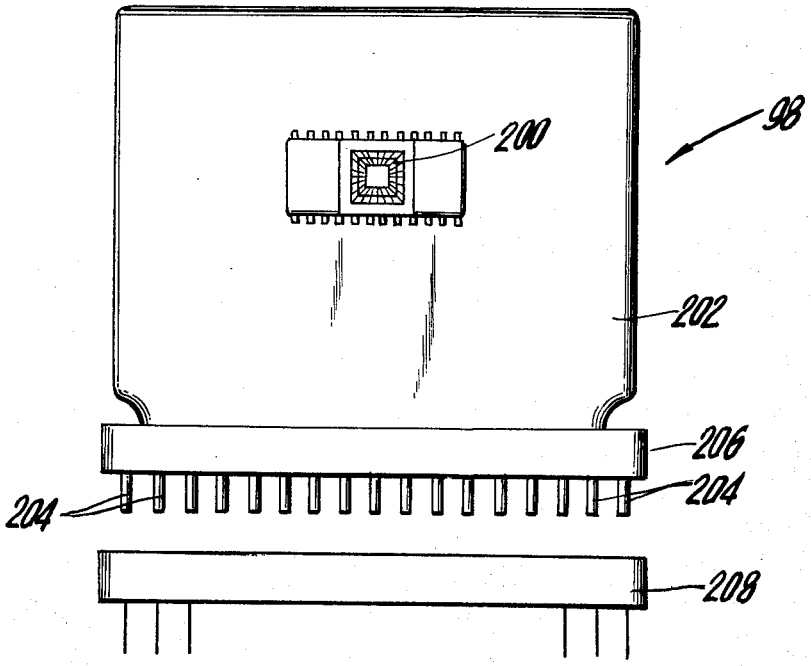
FIG. 4 is a planned view of a plug-in arrangement for the memory in FIG. 2.

The memory 98 of FIG. 2 is, according to an embodiment of the invention, in the form of a programmable read-only memory, often referred to as a programmable ROM, or PROM. As FIG. 4 shows, the memory is composed of a semi-conductor chip 200 or a similar storage structure mounted a circuit board 202. The chip forms a circuit or other structure which is electrically the equivalent of a patch board and a stepper relay. The chip includes terminals which connected to electrical pins 204 at a plug 206 on the end of the circuit board 202. The memory thus constitutes a self-contained unit which may be plugged into a jack 208 permanently secured in the electronic system 50.

Commerical means are available for programming PROMs and for making copies from an original in a few minutes. Each time suitable voltages or currents energize a set of pins 204, and hence terminals on the chip 200, with an appropriate binary coded number, namely an "address", the PROM produces signal voltages on other terminals and pins 204 which yield the information which had previously been programmed at that address. An electronic counter composed of the address register 97 and the timing control 96 is used to sequence the address numbers through the PROM. The outputs of the memory are used ultimately to control the stepping motors which drive the guide bars.

Commercial PROMs are available in typical integrated circuit configuration. They are about 1 inch by ½ inch by ⅛ inch in size. Yet they can store programming information equal to hundreds of chain links. Additional PROMs are also readily programmed to contain a plurality of shorter programs. Any particular short program may be selected by selecting the appropriate starting place in the PROM's total memory. However, in the simplest form each PROM contains one pattern.

As can be seen from FIG. 4, exchanging one program for another is readily accomplished by removing the circuit board 202 containing the PROM from its socket and plugging in a new circuit board containing the desired PROM.

In operation, a suitable circuit board 202 containing a desired PROM is plugged into the socket 208. A jogging control button, not shown, is then pressed to move the respective motors to their proper starting positions as the particular new program requires. Each operation of the switch pulses the stepping motor and causes one motor step in whichever direction the direction control was set. The control system is then ready for operation. As the main shaft 72 turns, the needle control 10 which is of a conventional kind causes the needles 16 to reciprocate. At the same time the guide bar rocker 36 rocks the guide bars 20 to 26 back and forth. When the guides 18 are to moved in front of the needles a number of steps, the indication 82 is sensed by the sensor 84 and the Schmitt trigger 90 as well as the delay multivibrator 92 cause the timing control 96 and the address register 97 to interrogate the memory 98 to determine the number of steps the stepping motors 52 to 58 are to move the bars 20 to 26 longitudinally. The control circuits 126 to **126*c* respectively turn each of the motors 52 to 58 specific numbers of steps commanded by the memory 98. The pinion 60, the racks 62, and the levers 64 and 66 move the respective bars 20 to 26 the proper distances as determined by the rotation of the motors 52 to 58. The distance moved by each guide bar for each step of the stepping motors is determined by the location of the pin 158 relative to the fulcrums 68 and 70 on each lever 62 and 64. When in front of the needles the guides may move as much as six in either direction, depending upon the content of the program in memory 98. However, when the guides move to the rear of the needles this movement must be limited to not more than one step. Therefore when the guides have moved their prescribed number of steps at the front of the and pass through the interdigital spaces between the needles 16, the sensor 86 senses an indication 88 and operates Schmitt trigger 119, multivibrator 120 and differentiator 121 so as to step the respective stepping motors 52 to 58 not more than one step. In effect the Schmitt trigger 119, multivibrator 120, and differentiator 121, as well as the sensor 86, represent a second synchronizing channel separate from the channel composed of Schmitt trigger 90 and delay multivibrator 92.** This use of two separate synchronizing channels limits the movement of the bars to one step when additional steps might otherwise cause damage to the machine. The double channel operation synchronizes the knitting machine so as to cause lateral movement of the guides only when they are clear of the needles. It also assures movement of not more than one step, i.e. when the guides are behind the needles.

Various types of sensors comparable to 84 and 86 may be used according to various embodiments of the invention. These sensors may sense magnetic electrostatic or various other types of indications. The dual synchronization insures that multiple stepping connot occur at forbidden times.

The memory 98 is effectively interrogated by conventional electronic circuits. Conventional circuits also convert its coded output to appropriate logic levels and implify them to power levels needed for energizing the coils of the stopper motors. As mentioned the separately synchronized channels prevent movement of more than one step when the guides are behind the needles. Manual jogging by operating switches S1 and S2 is a simple means to align the guides to any desired initial positions and for testing the mechanical system. Such jogging is possible only when the guides are in front of needles.

The use of changeable and pluggable memories makes changing far more simple and reliable than changing chains or cams. Similarly the PROMs are easily suceptable to copying with a few minutes by means of commercial apparatuses. A number of machines can be operated from identical programs with very little additional cost of labor for programming and installation. According to other embodiments of the invention alternate memory means such as punched cards, punched tape, magnetic tape, magnetic discs, or any other information storage means are used. However, the programmed read-only memory is preferred because of its simple reproduceability and replaceability.

As shown, a rack and pinion converts the rotary motion of each motor to substantially linear motion. However, as shown in FIGS. 1 and 3, in contrast to conventional racks which travel in straight lines parallel to their lengths under restraint of stationary guides, each rack shown connects at one end to a lever and is constrained near the other end by a roller 144. The roller is spring loaded to press continuously against the back of the rack and maintain a forceful engagement between the teeth of the rack and the pinion. Any slight errors which this arrangement produces in positioning can be eliminated by proper dimensions.

Biasing the roller 144 against the rack 62 so as to press it against the pinion 60 insures the elimination of slack in the engagement between the teeth. This contrasts with conventionally mounted racks, spur gears or other alternatives. There the parts would have to be made very precisely to keep the slack or backlash at the teeth within acceptable limits. Commonly, racks are guided by adjustable gibs, the position of which may be precisely fixed by means of set screws. However, a slack-free fit at one part of the rack may result in either binding or slack at other parts due to variations in spacing between the pitch line and the back of the rack. Thus, the conventional rack must include some backlash.

As the parts wear during their lifetime of operation, slack-free operation continues in the arrangement shown in FIG. 3. This contrasts with other types of mechanisms. In a knitting machine the guide bars must occasionally be used anywhere in their rated range of travel. But some bars are used mostly near their "0" positions corresponding to the thinnest chain link when programming chains are used. This means that unequal wear is to be expected in gears, racks, screws or other mechanisms.

According to the invention the steady force of the rack against the driving pinion removes radial play from the bearings supporting the gear shaft. This is advantageous in reducing shocks on the bearings and extends the life of the bearings. Reducing radial play in the bearings also increases the accuracy of the gear position. The arrangement shown provides a low cost means for maintaining backlash-free performance throughout the life of the machine. Optimum performance of the stepping motor is also dependent upon minimum backlash because much energy can be wasted when knocking due to backlash occurs.

The large motion of each rack such as 62 is reduced at the guide rods and therefore provide precise positioning with low cost gears. The ball swivel ends may be replaced with any type of universal joint that is slack-free.

Adjustment of the fulcrum 68 by means of the screw 172 permits the machine to be adjusted even while it is running. Essentially the adjusting screw is turned as necessary to provice the smoothest running operation.

Adjustment of the position of the pin 158 along the levers 64 and 66 permits simple changing from different needle spacings such as 1/24 inch to 1/28 inch. The friction brakes 180 to 188 are set by trial and error to achieve optimum stepper motor performance. The friction torque required is generally higher when the inertia of the guide bars is greater.

The friction brakes 180 to 188 are applied to extensions (not shown) between the shafts of the motors 52 to 58 and the pinions 60. Each brake is adjustable to apply torques from 0% to 80% of the maximum torque of the motor and set at approximately 50%. The brakes actually increase the speed at which the motors can be permitted to operate. This is so because each brake prevents oscillations which might occur at the end of each step and which would cause a motor to reverse if the motor speed were high enough. Nevertheless, setting of a brake at approximately 50% of the maximum torque of the motor produces a change of 5% or less in the current and power that is applied to each motor at approximately constant voltage. That is to say, full load power or current changes 5% or less from the condition when no brake is applied to the motor shaft to the condition when a brake is applied and set at approximately 50% of the maximum torque. Actually, a 2 to 3% change in power and current is typical.

According to a preferred embodiment of the invention the brakes are disc brakes using multiple discs. According to one embodiment brakes are set to apply torques in excess of 80% of maximum torque of the motor.

The use of brakes on the shaft of each motor is based upon recognition that stepping motors are inherently inefficient and that braking has little effect upon the efficiency so that little change in power or energy consumption results. The application of a braking force is also based upon the recognition that a stepping motor is constantly starting and stopping the rotation of a shaft, and that the brake assists the motor in its stopping operation. While it hinders the starting operation somewhat, the braked condition ultimately produces the advantage of allowing the entire system to be operated at a higher rate of speed. This is particularly true of inertial guide bar loads.

According to one embodiment of the invention, when the inertia of the load is comparatively small, the brakes are set at approximately 20% of the maximum torque. According to another embodiment of the invention, the brakes are set at between 20% and 80% of the maximum torque. According to yet another embodiment of the invention, the brakes are set in excess of 40% of the maximum torque and preferably between 40% and 60% of the maximum torque of each motor. According to yet another embodiment of the invention, for loads of high inertia, the brakes are set to be in excess of 60% of the maximum torque.

As can be seen, the invention provides a number of advantages. It provides means for storing programs many times greater than presently available systems offer. It is potentially and actually less costly than systems which provide similar accuracy and reliability. It permits changing of programs within a few minutes. It pwemits changing of needle spacing without the need of new parts. It provides smoother motor forces that result in less shock, less noise, and less wearing of parts. The synchronizing means allow the pattern bars to be moved as soon as the guides clear the needle. This allows the knitting machine to operate at higher speeds than heretofore expected.

The system according to the invention does not require springs which act in opposition to cams. The guide bar location can be adjusted without stopping the machine and thereby producing a stop mark, a form of defect which renders the knitted fabric less valuable. This adjustment is accomplished by screws such as screw 172. Moreover, each stable position of the stepper motor can be made to correspond to a safe position for the guides.

According to a preferred embodiment of the invention, the pattern bar control 40 is related to the spacing of the guides 18 and the needles 16 so that each step of each stepping motor 52, 54, 56, and 58 moves each guide bar 20, 22, 24, and 26 longitudinally from one safe position in which the guides 18 cannot interfere with the needles 16, directly to another position in which the guides 18 cannot interfere with the needles 16, without stopping at any intermediate positions. Each stepping motor can normally stop only in a stable position, and each stable position of each stepping motor produces a longitudinal guide position which is safe. The term "safe position" as used herein represents a position in which rocking movement of the guide bars by the rocker 36 in the direction of arrows 38 and movement of the needles 16 by the control 10 along the direction of the arrows 14 does not cause interference between the needles 16 and the guides 18. In these safe positions of the bars 20 to 26 the needles pass between the guides.

This one-to-one relationship of guide bar movement and motor steps prevents the system from being stopped at a location in which the guides 18 could interfere with the needles. Moreover, if a motor should accidently skip one step the bars would not be placed in an intermediate position in which the guides 18 would interfere with the needles. Were several motor steps necessary to move the guides from one safe position to the next, the guides might step into an unsafe position. Of course, each pulse to the motor produces one step so that each pulse represents a movement from one safe position to another.

According to another embodiment of the invention, more than one PROM is used. Several PROMs then act together to furnish the information in the memory 98 of FIG. 2.

According to another embodiment of the invention, the braking action is applied electronically rather than by the drum 180, shoe 182, key 184, spring 186 and adjusting screw 188. In this embodiment each stepping motor driver 106 of each control circuit **126, 126*a*, 126*b*, and 126*c* includes a circuit that superposes a braking signal on each pulse to the respective motor. This braking signal is applied toward the end of the pulse and thereafter to slow down the motor, in its travel from one stable position to the next, just before the motor reaches the next stable position and thereafter. The circuit may simulate electronically the braking action of the brake assembly composed of members 180 to 188** at all times, or electronically simulate this braking action only in the latter portion of each cycle and immediately thereafter. The term "braking means" as used herein thus defines not only the mechanical brake shown but an electronic or magnetic equivalent.

While embodiments of the invention have been described in detail it will be obvious to those skilled in the art that the invention may be embodied otherwise without departing from its spirit and scope.

What is claimed is:

1. An apparatus for controlling one of a plurality of guide bars of a knitting machine in synchronism with at least one moving portion of the knitting machine so as to establish the characteristics of a knitting pattern, comprising: electrical signal producing means coupled to the portion of the machine for producing electrical signals which are in synchronism with the portion and which define a characteristic of the knitted pattern, electrical rotating means coupled to the signal-producing means for responding to the signals and producing rotary motion corresponding to the signals in the forward and backward directions, transforming means coupled to said rotating means for transforming the rotary motion to corresponding translatory motion for coupling the translatory motion to the pattern bar so that the pattern bar follows a path prescribed by the signals, said electrical signal-producing means including stored program means and pulse-forming means responsive to the program means for producing the signals in the form of discrete pulses, said rotating means responding to said variations by rotating in discrete steps and including an electrical stepping motor capable of responding to pulse signals by rotating a plurality of discrete steps for each revolution in the forward direction and in the backward direction so that each step represents a fraction of a revolution, and braking means coupled to one of said rotating means and said transforming means for braking the motion of one of said rotating means and said transforming means at least once during each step representing a fraction of a revolution.

2. An apparatus as in claim 1, wherein said transforming means includes a pinion coupled to said motor, and a rack movable longitudinally for producing translatory motion coupled to said coupling means.

3. An apparatus as in claim 2, said transforming means further including a resilient means biasing said pinion and rack against each other.

4. An apparatus as in claim 3, wherein said resilient means biases the pinion and the rack against each other in a direction having a component transverse to the direction of longitudinal movement of said rack.

5. An apparatus as in claim 3, wherein means biases said rack and pinion against each other in a direction substantially transverse to the longitudinal movement of said rack.

6. An apparatus as in claim 2, wherein said transforming means includes a lever mounted for pivotal movement and coupled to said rack for movement by said rack, said transforming means including transfer means secured to said lever for transmitting the motion of said lever to the guide bar.

7. An apparatus as in claim 6, wherein said transforming means includes adjusting means for changing the position at which said transfer means is secured to said lever, said adjusting means thereby changing the amount of motion imparted to the guide bar for each step of the stepping motor.

8. An apparatus as in claim 7, wherein said lever moves about a fulcrum, and wherein said transforming means includes means for changing the position of said fulcrum to thereby adjust the range of motion of the guide bar.

9. An apparatus as in claim 8, wherein said transforming means further includes resilient means biasing the pinion and the rack against each other in a direction substantially transverse to the longitudinal direction of movement of said rack.

10. An apparatus as in claim 1, wherein said stored program means includes a programmable read-only memory which stores a program for movement of the guide bar, said pulse-forming means being responsive to the portion of the knitting means for interrogating the memory and reading out from the memory to produce the pulses.

11. An apparatus as in claim 10, wherein said memory includes a semiconductor section and mounting means supporting the section, said mounting means being removably engageable with said forming means for permitting changes of the program.

12. An apparatus as in claim 11, wherein said circuit means includes a socket and said means includes a plug for plugging into said socket.

13. An apparatus as in claim 10 wherein said forming means includes two synchronizing channels each producing a synchronizing signal corresponding to one position of guides moved by the guide bar relative to needles in the knitting machine for gating the output of said memory to said stepping motor at times corresponding to the positions.

14. An apparatus as in claim 1, wherein said pulse forming means include two synchronizing channels each producing a synchronizing signal corresponding to a position of guides moved by the guide bar relative to needles in the knitting machine for gating the output of said stored program means to said stepping motor at times corresponding to the position, said channels being responsive to at least one moving portion of the knitting machine.

15. An apparatus as in claim 14, wherein said transforming means includes a pinion coupled to the motor, and a rack movable longitudinally for producing translatory motion coupled to said coupling means, said transforming means further including resilient means biasing said rack and pinion against each other in a direction substantially transverse to the longitudinal movement of said rack.

16. An apparatus as in claim 14, wherein said transforming means further includes a lever mounted for pivotal movement and coupled to said rack for movement by said rack, said coupling means including transfer means secured to said lever for transmitting the motion of said lever to the guide bar, said coupling means also including adjusting means for changing the position at which said transfer means is secured to said lever, said adjusting means thereby changing the amount of motion imparted to the guide bar for each step of the stepping motor.

17. An apparatus as in claim 16, wherein said transforming means includes a pinion coupled to the motor, and a rack movable longitudinally for producing translatory motion coupled to said coupling means, said transforming means further including resilient means biasing said rack and pinion against each other in a direction substantially transverse to the longitudinal movement of said rack.

18. An apparatus as in claim 14, wherein said pulse forming means includes rotatable means responsive to at least the one moving portion of the knitting machine and having two indications, one of the indications indicating that guides on the last one of the plurality of guide bars have cleared the front of the knitting needles, the other of the indications indicating the time that the guides in the last of the plurality of guide bars have cleared the backs of the knitting needles, said pulse forming means including sensing means for sensing the indications and producing the synchronizing signals along the two channels.

19. An apparatus as in claim 18, wherein said stored program means stores information for moving the stepping motor only a single step in response to the second indication and a plurality of steps in response to the first indication, said pulse forming means including addressing-buffer means for addressing the stored program means in response to signals from said sensing means and holding them in a buffer and gating means responsive to the synchronizing signal on one channel which responds to the first indication for gating the output of said stored program means held to said stepping motor and thereafter responding to the signal on the other channel for gating other information to said stepping motor.

20. An apparatus as in claim 14, wherein said pulse-forming means includes jogging means for electrically pulsing said stepping motor manually by one step at a time.

21. An apparatus as in claim 1, said guide bars defining a plurality of safe positions in which operation of the knitting machine moves the guides and needles of the knitting machine relative to each other without interference, wherein said stepping motor rotates in the discreet steps between stable adjacent positions, and wherein said transforming means is related to the safe positions and the stepping motor so that the guide bar assumes a safe position for each stable rotational position of the motor.

22. An apparatus as in claim 21, wherein said transforming means includes a pinion coupled to said motor, and a rack movable longitudinally for producing translatory motion coupled to said coupling means.

23. An apparatus as in claim 22, wherein said transforming means further includes resilient means biasing the pinion and the rack agains each other in a direction substantially transverse to the longitudinal direction of movement of said rack.

24. An apparatus as in claim 21, wherein said stored program means includes a programmable read-only memory which stores a program for movement of the guide bar, said pulse-forming means being responsive to the portion of the knitting means for interrogating the memory and reading out from the memory to produce the pulses.

25. An apparatus as in claim 21, wherein said pulse-forming means includes two synchronizing channels each producing a synchronizing signal corresponding to a position of guides moved by the guide bar relative to needles in the knitting machine for gating the output of said stored program means to said stepping motor at times corresponding to the position, said channels being responsive to at least one moving portion of the knitting machine.

26. An apparatus as in claim 18, said guide bars defining a plurality of safe positions in which operation of the knitting machine moves the guides and needles of the knitting machine relative to each other without interference, wherein said stepping motor rotates in the discreet steps between adjacent stable positions, and wherein said transforming means is related to the safe positions and the stepping motor so that the guide bar assumes a safe position for each stable rotational position of the motor.

27. An apparatus as in claim 10, said guide bars defining a plurality of safe positions in which operation of the knitting machine moves the guides and needles of the knitting machine relative to each other without interference, wherein said stepping motor rotates in the discreet steps between adjacent stable positions, and wherein said transforming means is related to the safe positions and the stepping motor so that the guide bar assumes a safe position for each stable rotational position of the motor.

28. An apparatus as in claim 1, wherein said braking means applies a braking force in a range of 20% and more of the maximum torque produced by the motor.

29. An apparatus as in claim 1, wherein said braking means applies a braking torque between 20% and 80% inclusive of the maximum torque produced by said motor.

30. An apparatus as in claim 1, wherein said braking means produces a braking torque between 40 to 60% of the maximum torque applied by the motor.

31. An apparatus as in claim 1, wherein said braking means applies a torque in excess of 60% of the maximum torque applied by the motor.

32. An apparatus as in claim 1, wherein said rotating means includes a rotating extension coupled to the output of the motor and said braking means applies the torque to the extension.

33. An apparatus as in claim 32, wherein said braking means applies a braking torque of 20% or more of the maximum torque produced by said motor.

34. An apparatus as in claim 32, wherein said braking means produces a braking torque between 20% and 80% of the maximum torque applied by the motor.

35. An apparatus as in claim 32, wherein said braking means applies a torque between 40% and 60% of the maximum torque applied by the motor.

36. An apparatus as in claim 5, wherein said braking means produces a braking torque of 20% or more of the maximum torque applied by the motor.

37. An apparatus as in claim 10, wherein said braking means produces a braking torque of 20% or more of the maximum torque applied by the motor.

38. An apparatus as in claim 14, wherein said braking means applies a torque of 20% or more of the maximum torque applied by the motor.

39. An apparatus as in claim 18, wherein said braking means applies a torque of 20% or more of the maximum torque applied by the motor.

40. An apparatus as in claim 30, wherein said braking meand applies a torque of 20% or more of the maximum torque applied by the motor.

41. The method of controlling one of a plurality of guide bars of a knitting machine in synchronism with at least one moving portion of the knitting machine so as to establish the characteristics of a knitting pattern, which comprises: producing electrical pulse signals in synchronism with the portion from a stored program which defines a characteristic of the knitted pattern so that the pulse signals define a characteristic of the knitted pattern, applying the pulse signals to a stepping motor which turns a plurality of discrete steps for one revolution so that each step represents a fraction of a revolution and producing forward and backward rotary motion with the stepping motor in response to the pulse signal, and applying the rotary motion to the bar as translatory motion, and braking one of the motions at least once during each step representing a fraction of a revolution.

42. The method as in claim 41, wherein the step of producing pulse signals includes producing a synchronizing signal along each of two synchronizing channels, each synchronizing signal corresponding to a position of the guides moved by the guide bar relative to the needles in the knitting machine for gating the output of the stored program to the stepping motor at times corresponding to the position, and synchronizing the channels to at least one moving portion of the knitting machine.

43. The method as in claim 41, wherein the rotary motion is transformed to translatory motion by a rack and pinion and the transformation includes resiliently biasing the rack and pinion against each other with a component transverse to the direction of longitudinal movement of the rack.

44. The method as in claim 42, wherein the step of forming pulse signals responds to at least the one moving part of the knitting machine and produces two indications, one of the indications indicating that guides on the last one of the plurality of guide bars has cleared the front of the knitting needles and the other of the indications indicating the time the guides in the last of the plurality of guide bars have cleared the backs of the knitting needles sensing the indications and producing the synchronizing signals along the two channels, one with each indication.

45. The method as in claim 44, wherein the step of producing pulse signals includes storing information for moving the stepping motor only a single step in response to the second indication and a plurality of steps in response to the first indication, addressing the stored program in response to signals sensed and holding them in a buffer, responding to the synchronizing signals on the one channel which responds to the first indication and gating the output of the stored program means to the stepping motor, and thereafter responding to the signal on the other channel for gating other information to the stepping motor.

46. The method as in claim 45, wherein the step of producing pulse signals includes producing a synchronizing signal along each of two synchronizing channels, each synchronizing signal corresponding to a position of the guides moved by the guide bar relative to the needles in the knitting machine for gating the output of the stored program to the stepping motor at times corresponding to the position, and synchronizing the channels to at least one moving portion of the knitting machine.

47. An apparatus for controlling one of a plurality of guide bars of a knitting machine in synchronism with at least one moving portion of the knitting machine so as to establish the characteristics of a knitting pattern, comprising: electrical signal-producing means coupled to the portion of the machine for producing electrical signals which are in synchronism with the portion and which define a characteristic of the knitted pattern, electrical rotating means coupled to the signal-producing means for responding to the signals and producing rotary motion corresponding to the signals in the foreward and backward directions, coupling means for coupling the motion of the rotating means to the pattern bar so that the pattern bar follows a path prescribed by the signals, said electrical signal-producing means including stored program means and pulse-forming means responsive to the program means for producing the signals in the form of discreet pulses, said rotating means responding to said variations by rotating in discreet steps and including an electrical stepping motor capable of responding to pulse signals by rotating discreet steps in the forward direction and in the backward direction, and braking means coupled to said coupling means for braking the motion of said coupling means.

48. An apparatus as in claim 1, wherein said braking means brakes the motion of the one of said rotating means and said transforming means substantially continuously during operation of the stepping motor means.

49. The method of claim 41, wherein the step of braking includes braking one of the motions through the stepping action of the motor.

* * * * *